US006352324B1

(12) United States Patent
Pagnon et al.

(10) Patent No.: US 6,352,324 B1
(45) Date of Patent: Mar. 5, 2002

(54) INK JET PRINTING DEVICE AND CIRCUIT

(75) Inventors: Alain Pagnon, Valence; André Souvignet, Chateaudourie, both of (FR)

(73) Assignee: Imaje S.A., Bourg les Valence Cedex (FR)

( * ) Notice: Subject to any disclaimer, the term of this patent is extended or adjusted under 35 U.S.C. 154(b) by 0 days.

(21) Appl. No.: 09/334,975

(22) Filed: Jun. 17, 1999

(30) Foreign Application Priority Data

Jun. 29, 1998 (FR) ..... 98 08225

(51) Int. Cl.[7] ..... B41J 29/38
(52) U.S. Cl. ..... 347/6
(58) Field of Search ..... 347/6, 19, 7, 89, 347/74; 346/1.1, 140, 75

(56) References Cited

U.S. PATENT DOCUMENTS 4,074,284 A 2/1978 Dexter et al.
4,346,388 A * 8/1982 Wiley ..... 346/75
4,639,738 A 1/1987 Young et al.
4,809,015 A 2/1989 Bowling et al.
4,811,035 A 3/1989 Huliba et al.
5,055,857 A 10/1991 Regnault
5,311,214 A * 5/1994 Hiirasawa et al. ..... 346/1.1
5,455,606 A 10/1995 Keeling et al.

FOREIGN PATENT DOCUMENTS

EP 646 470 A2 4/1995
EP 839 659 A1 5/1998

* cited by examiner

*Primary Examiner*—John Barlow
*Assistant Examiner*—Charles W. Stewart, Jr.
(74) *Attorney, Agent, or Firm*—Pearne & Gordon LLP

(57) ABSTRACT

The present invention relates to an ink circuit comprising an ink cartridge (10), an additive cartridge (11), a recovery tank (12), a storage tank or accumulator 913), a main filter (24), solenoid valves (8), an ink transfer pump (14) equipped with a pressure/temperature sensor (53), an air pressure regulator (30), said ink circuit comprising a double face support unit with a hydropneumatic face and an electronic face making it possible to separate the hydraulic, pneumatic and electronic assemblies, all the functional components being fitted outside on one or other of the two faces.

15 Claims, 6 Drawing Sheets

HEAD PRESSURIZATION
ELECTRONIC SCANNING
INK CIRCUIT SCAVENGING
HEAD
GROOVE SUCTION
NETWORK
EXTERNAL DISCHARGE
10
11
12
13
14
20
21
22
22a
23
24
25
30
31
32
33
34
35
35a
37
38
40
41
42
43
44
45
46
50
53

INK JET PRINTING DEVICE AND CIRCUIT

DESCRIPTION

1. Technical Field

The present invention relates to an ink circuit, as well as to an ink jet machine and a conditioning machine or a conveyor using such a circuit.

2. Prior Art

A prior art device is described in U.S. Pat. No. 4,862,192. This device is an ink jet point printer, with an ink circuit incorporating a device for the transfer of thick ink from a first supply tank and, independently thereof, additives from a second supply tank, into an ink chamber. Ink from said ink chamber is supplied under pressure to a writing head. Ink is returned to the ink chamber through a recovery channel, traversing the writing head and recovering the ink droplets which have not been deflected for writing purposes. The transfer device uses pressurized air for transporting the ink between an ink tank connected to the writing head, a mixture tank connected to the supply tanks, and a recovery tank connected to the recovery channel. The mixture or mixing tank can be alternatively connected to a suction line or to a delivery line.

This device suffers from numerous disadvantages. It requires the use of an air pressure regulator, which must be precise, fast, have no hysteresis so as not to modify the printer operating conditions, have a passage diameter of considerable size at the outlet so as not to lead to an overpressure during ink transfers accompanying a high pump capacity. It does not permit an ink jet droplet speed regulation. It has a manual, precision pressure regulator. It has two other air pressure regulators, which increases to three the number of regulators used. It uses a transfer pump (volume) with a considerable displacement of a unidirectional nature. This non-reversible pump does not make it possible to implement rapidly all the cycles necessary for a printer rinsing or emptying or an ink colour change. It uses a main filter downstream of the accumulator or storage tank, which requires a permanent adjustment of the operating pressure in order to compensate a clogging thereof. Additive addition is a function of the operating conditions and requires a manual setting. The electrical/hydraulic separation is brought about by using solenoid valves, which control pneumatically controlled valves. This relaying principle increases the number of components (cost and reliability aspects). It has components integrated in the interior of a machined unit. It has no temperature sensor. Therefore temperature variations can be interpreted as ink quality variations.

The invention is therefore directed at an ink circuit making it possible to obviate these various disadvantages.

DESCRIPTION OF THE INVENTION

The present invention describes an ink circuit more particularly comprising an ink cartridge, an additive cartridge, a recovery tank, an accumulator or storage tank, a main filter, solenoid valves, an ink transfer pump equipped with a pressure and temperature sensor, which provides information on the operational hydraulic and thermal conditions and an air pressure regulator, said ink circuit being characterized in that it comprises a double face support unit having a hydropneumatic face and an electronic face making it possible to separate the hydraulic, pneumatic and electronic assemblies, all the functional components being fitted outside one or other of the two faces.

Advantageously, the relative arrangement of certain components contributes to an improvement in the overall functionality of the ink circuit. Thus, the air/ink separation is ensured by an arrangement of the air-operating components in the upper part of the circuit and the mainly ink-operating components in the lower part thereof (natural separation by gravity). The pump is also located below the recovery tank and the storage tank, so as to naturally ensure a purging of said pump.

In the storage tank, a first liquid-pressure regulation is assured by the pump, whilst a second air-regulation is assured by means of two solenoid valves, one being located between the storage tank and one or more head pressurizations through gauged orifices and the other between the gauged orifice or orifices and the pressure regulator.

The first solenoid valve makes it possible to inflate or deflate the storage tank independently of the pump.

The second solenoid valve makes it possible to control the head pressurization, said option being directly controlled by the software in order to have a permanent pressurization of the head, said solenoid valve being in the open position (permanent electrical control) and for eliminating pressurization, the control of said solenoid valve being deactivated.

A third solenoid valve makes it possible to control the supply of a venturi tube (vacuum generation). This solenoid valve more particularly makes it possible to stop the vacuum on stopping the ink jet or jets. This in particular prevents any ink quality drift (needless evaporation), which occurs on stopping the ink jet on circuits not having the possibility of stopping vacuum generation.

Advantageously, the pressure sensor, which can be located in the pump, makes it possible to control the driving pressure of the pump. The driving pressure control cycle is controlled by solenoid valves.

The pressure read by the pressure/temperature sensor is then very close to the pressure prevailing in the chamber. This pressure is also very close to the pressure prevailing at the pressure regulator outlet. This sensor then has a pressurestat function and is then used for controlling the presence of the air system or network.

The pressure and temperature sensor makes it possible, during the phase of setting the operating parameters of the machine, to obtain information on the set pressure at the regulator outlet and on the vacuum in the recovery tank. On other prior art circuits, these informations are given by a needle pressure gauge (solely for indicating the regulated or set pressure) and a needle vacuum gauge (solely for indicating the operating vacuum). This sensor makes it possible to avoid the multiplicity of components and gives a more precise and simpler information (the pressure level being read directly on the screen or display of the machine) than needle indicators or gauges. This information can be directly used by software.

Advantageously, the hydraulic and pneumatic links within the circuit take place without using pipes or tubes and without any connection, being directly integrated by moulding into the unit in the form of channels. The hydraulic links with the head are implemented by fast, self-sealing couplings. The air filters are fitted to the unit by a fast fixing system (screwing or bayonet). No pipe is connected to said filters, so that the replacement of these components becomes a simple, clean operation requiring no tool (possibility of manual fitting and dismantling).

Moreover, the accessibility of the ink and additive cartridges and the main filter associated with the use of the reversible pump ensures a rapid colour change.

Advantageously, the ink circuit comprises a double pressure regulation accumulator (by air or liquid). The first regulation functions in liquid by means of the pump and corresponds to the ink supply of the jet, whilst the second regulation functions in air.

This regulation in air in particular makes it possible to relay the liquid regulation when the tanks containing the ink are empty. Thus, use is made of all the ink contained in the machine (including that of the storage tank) prior to the declaration of a blocking fault for the machine. It also ensures the maintaining of a stable pressure in said storage tank throughout the cycle of placing the cartridges under atmospheric pressure. It also ensures the supply of the air pocket of the storage tank without passing via the pump. It also permits a very rapid variation over the entire extent (extending from the vacuum generated by the venturi tube up to the outlet pressure of the regulator) of the pressure prevailing in said storage tank, said rapid and controlled variations of the pressure in the storage tank being used for the stopping and starting cycles of the jet or jets or for carrying out a rapid filling of the storage tank (possibility of placing the storage tank under vacuum). The regulation of the pressure in air of the storage tank is associated with an electrical supply time of the control solenoid valve, whereas the pressure upstream of the solenoid valve is either the atmospheric pressure when the solenoid valve is closed and it is wished to reduce the storage tank pressure, or the regulated pressure present at the outlet of the regulator when the solenoid valve is open and it is wished to increase the storage tank pressure.

Advantageously, the ink circuit comprises a main filter for the ink located between the pump and the storage tank.

Advantageously, the ink circuit comprises a single contactless level detector (intrinsic security by design), a programmable efficiency condenser (function of the ink type, ambient temperature, cycles taking place, etc.) located at the outlet of the recovery tank for condensing and recovering the volatile components of the ink and said condenser can e.g. be based on a Peltier effect cell.

Advantageously, the ink circuit comprises a regulatable venturi tube (vacuum generation) protected by a coalescence filter. The coalescence filter, located at the inlet of the circuit controls and ensures the quality of the air (pollution levels, relative humidity and oil quantity). The purging of said filter is of a permanent nature through a gauged orifice. Such a purging principle involves no moving part, which gives it a reliability level much higher than in existing automatic systems.

Advantageously, the outlets of the filter and venturi tube are located close together, so as to bring about a dilution of the venturi tube discharges.

The electronic and fluidics assemblies are permanently scavenged by an air flow having a quality controlled by the coalescence filter. These scavenging operations create a slight overpressure within the machine, so that there is a high degree of dust protection (e.g. IP6X).

The scavenging of the electronic and fluidics parts remain present when the machine stops. The scavenging operations are only conditioned by the presence of the air system at the filter intake.

The outlets of the coalescence filter and the venturi tube are connected to the same component T, whose third orifice is connected to the outside of the machine, which makes it possible to dilute the solvent vapours discharged to the outside, so that the pollution level is very low and well under accepted levels. In a constructional variant, the same effect can be obtained without connecting the two outlets (filter and venturi tube), but instead by individually connecting them in the lower part of the machine. The two connections would then be close to one another.

Advantageously, the ink and additive cartridges are tight and maintained at a pressure close to atmospheric pressure by the storage tank air, as a result of an adapted cycle of several solenoid valves, the operation being controlled by the pressure sensor.

The invention also relates to an ink jet machine using such an ink circuit and a conditioning machine or conveyor using such an ink circuit.

The ink circuit according to the invention gives rise to the following advantages.

The implementation of an autonomous electro-hydropneumatic circuit integrating all the sensors and actuators necessary for its operation and the associated control electronics. The ink circuit constitutes an autonomous assembly which can be likened to an automaton controlled by a series, bidirectional data link. This architecture makes it possible to install and test in an autonomous manner the complete circuit and also use the latter as a component in specific applications (e.g. multicolour printing).

The simplicity and very good separation of the assemblies (hydraulic, pneumatic, electronic), with two faces, including a hydropneumatic face and an electronic face. This separation in the arrangement of the components makes it possible to very easily separate or distinguish the fluidics zone (hydraulic side) and the electronic zone, with a clear advantage for the operating safety.

The implementation of a double face hydraulic circuit with ease of manufacture, access and maintenance. All the functional components (filters, venturi tube, pump, solenoid valves, pressure and level sensors, condenser, etc.) are installed outside one or other of the faces and are consequently rapidly accessible.

The implementation of a closed circuit (isolated from the ambient air).

When the machine stops, the circuit is isolated from the outside, which avoids the drying phenomena associated with air/ink exchanges.

The use of a numerically controlled air pressure regulator.

The integration of a pressure and temperature sensor in the ink transfer pump.

The use of a solvent recovery means (e.g. condenser with Peltier effect cell) with a programmable efficiency.

The particular position of the main filter makes it possible to envisage an optimized regulation of the ink quality and the clogging of the filter does not influence the ink quality, as well as an automated determination of the filter change.

The use of a coalescence filter for protecting the venturi tube, which is a sensitive element.

The determination of the ink levels in the different volumes by the pump.

The use of an entirely pneumatically controlled ink transfer pump, said reversible pump ensuring all the bidirectional liquid exchanges between all its neighbours (cartridges and tanks).

A very low thermal balance linked with the fact that the "motor" of the printer is the pressurized air of the factory network, which makes it possible to predict a very small internal temperature rise (<5° C.).

Unlike in the case of the previously described prior art device, the ink circuit according to the invention makes it possible:

to continuously regulate the ink jet droplet speed, electronically regulate the pressure, with a permanent servo-control, transfer the liquid in any random condition, the pump of the circuit according to the invention having the functions of transferring liquid between two tanks, stirring and agitating a tank, measuring the transferred volume, measuring the pressure (vacuum) in a tank, measuring the level in a tank, measurement more particularly taking place of the air quantity in the pressurized tank (accumulator), knowing the total volume thereof and the ink volume and in particular ink level in said accumulator is deduced by subtraction and control of the pressure of the network, to decorrelate the clogging level of the main filter located between the pump and the storage tank from the viscosity of the ink, the pressure being automatically compensated and a dynamic measurement (calculation of the transfer energy in the storage tank) provides the information as to whether the filter is clogged, of no longer having the additive addition dependent on the operating conditions (everything takes place through the pump, which has a known chamber volume), to implement the electrical/hydraulic separation within the solenoid valves using separating membranes or diaphragms, which bring about a physical separation between the electrical part and the hydraulic part, so that the solenoid valves are directly controlled, to use a double face circuit with two isolated, pressurized compartments, the maintenance of the first level taking place solely in the hydraulic component at the front of the machine, to use a pressure and temperature sensor integrated into the pump, so that it is possible to control the ink quality, to use a contactless level detector placed on the wall of the recovery tank giving information (analog output or several level values) on the level and therefore volume of the ink contained in the recovery tank, to use the knowledge of the ink volumes contained in the recovery tank, storage tank and pump chamber so as to be able to entirely control the additive concentration corrections necessary for maintaining the ink quality, to use a condenser (e.g. Peltier effect type), whose efficiency can be controlled as a function of the temperature in accordance with the operating characteristics, so as to discharge less vapours of the volatile components of the ink.

These characteristics of the circuit according to the invention make it possible:

to reduce the number of components (pipes, couplings, small support units, etc.), to have a compact circuit, to directly integrate with the support unit the tanks (buffer, storage, condenser), to reduce the costs to a significant extent by directly obtaining by moulding the support unit for all the components, to adequately separate the electronic and hydropneumatic parts (important for safety standards), to limit the first level maintenance interventions to a single face of the circuit (front face directly accessible by the operator), to simplify maintenance (all the components being accessible from the outside without any prior dismantling), to obtain an autonomous ink circuit integratable into units other than ink jet printers, all that is required consists of the electrical power, compressed air and appropriate controls (through the series control link) in order to make the circuit function—said autonomy concept making it possible to simplify manufacture (complete integration test in air based on a computer).

DETAILED DESCRIPTION OF EMBODIMENTS

Figure 1:
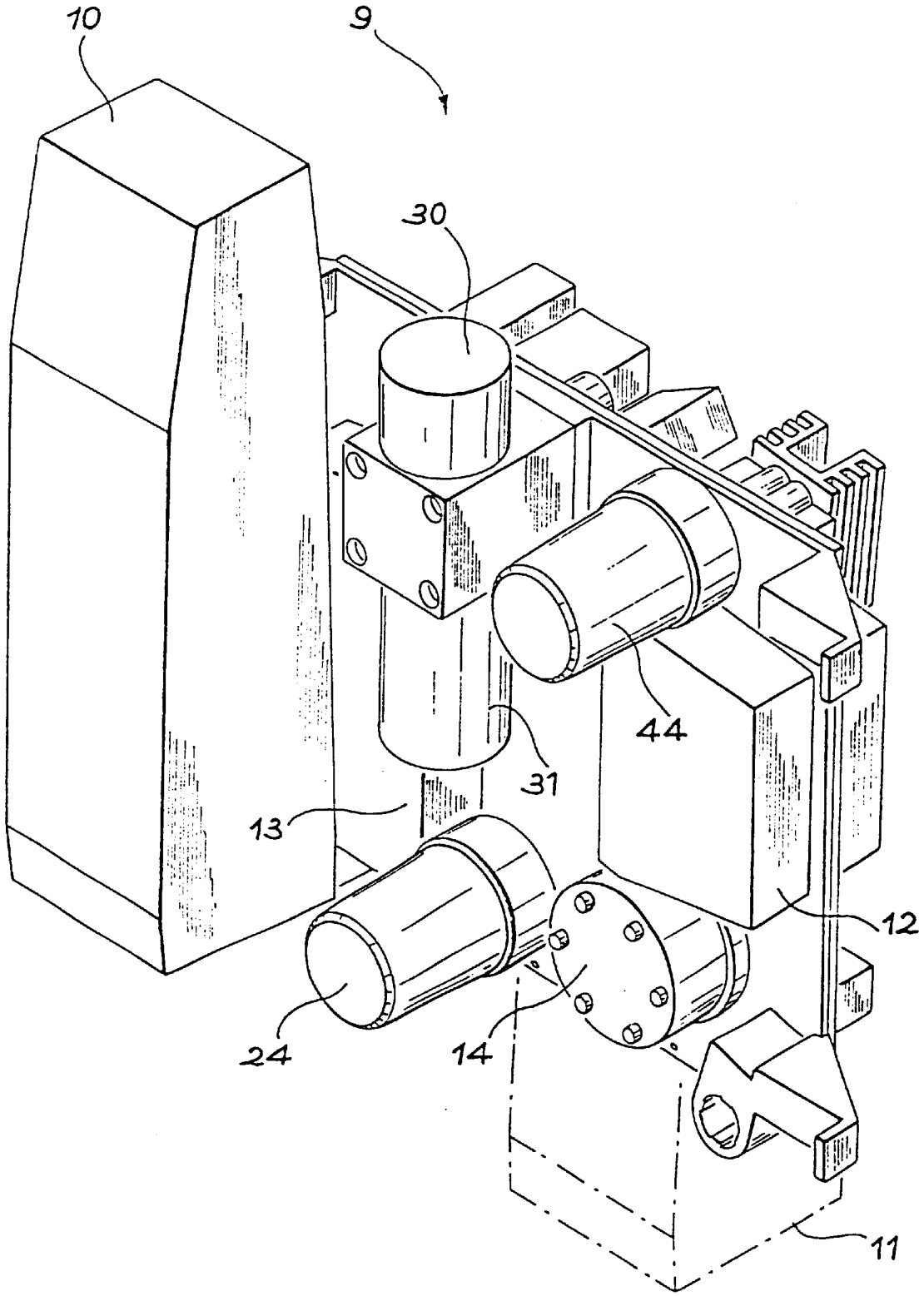
FIGS. 1 and 2 illustrate the ink circuit according to the invention, respectively on a front view and a rear view.
Figure 2:
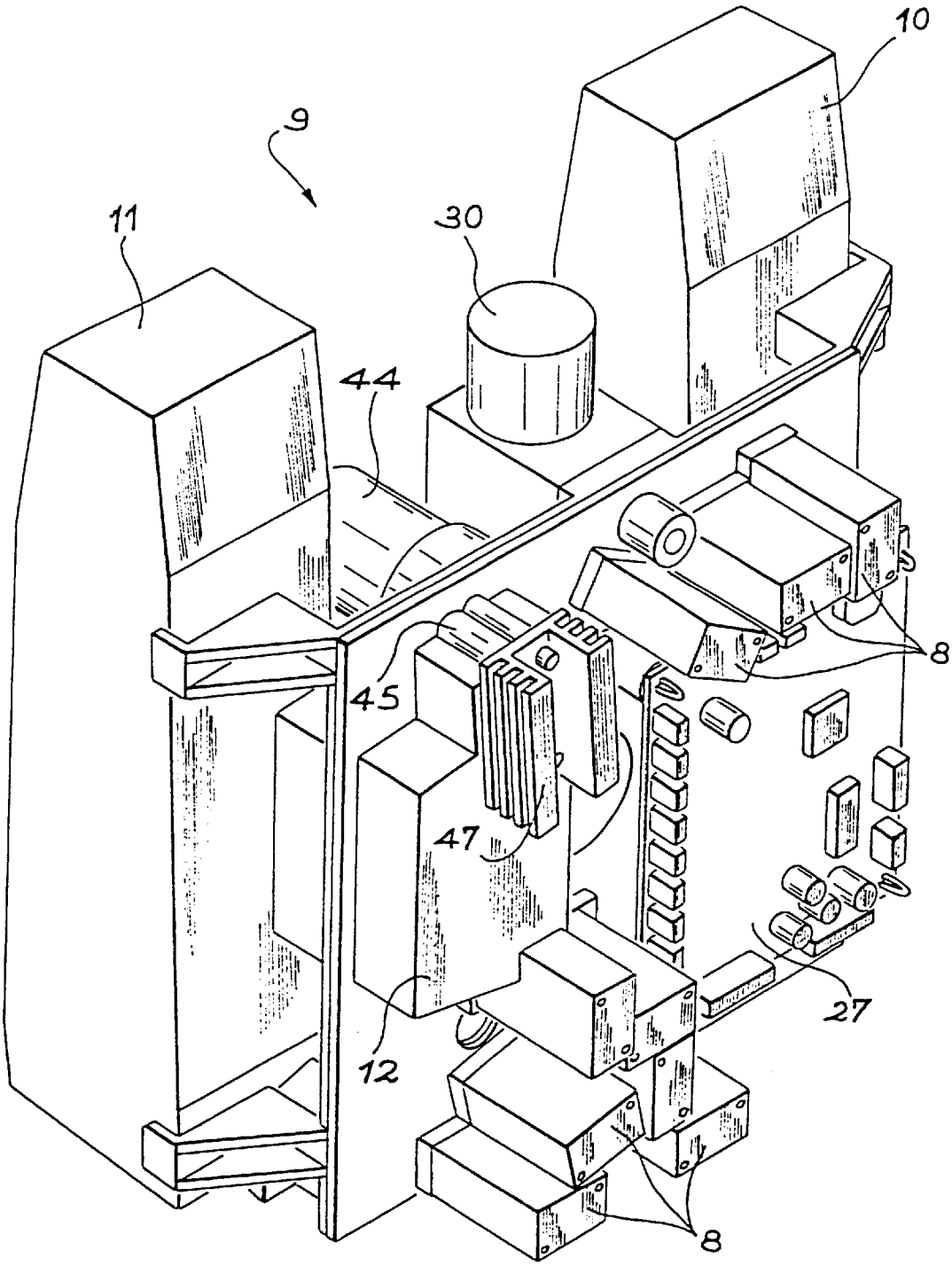
Figure 3:
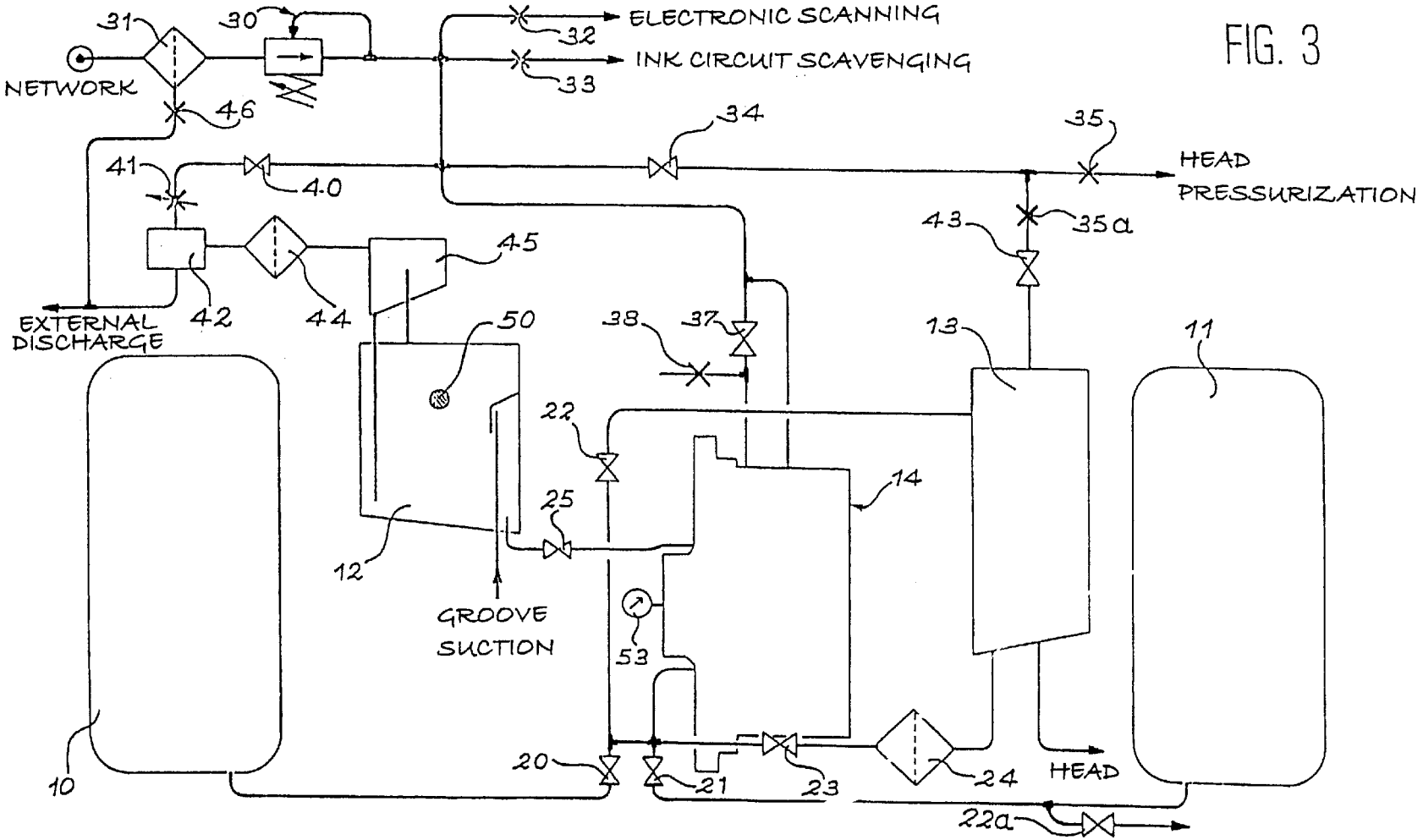
FIG. 3 The hydropneumatic diagram of the ink circuit according to the invention.

The in circuit 9 shown in FIGS. 1, 2 and 3 comprises an ink cartridge 10, an additive cartridge 11, a recovery tank 12 and an accumulator or storage tank 13, each of said components being connected to an ink transfer pump 14, air filters 31, 44, an ink filter 24, a pressure regulator 30, a condenser 45 and its radiator or heater 47, connecting channels on which are located solenoid valves 8 (or 20, 21, 22, 23, 25, 34, 37, 40, 43 ), and an electronic card 27 for controlling these different components.

The front face of the circuit illustrated in FIG. 1 carries the hydraulic and pneumatic components (filters 24, 31 and 44; pump 14; storage tank 13; cartridges 10 and 11; regulator 30 ) accessible from the outside, the hydraulic components being located in the lower part and the pneumatic components in the upper part. The rear face of the circuit, illustrated in FIG. 2, has the electrical and electronic components (solenoid valves 8, condenser 45, pressure/temperature sensor 53, level sensor 50 and electronic card 27 ).

The lower parts of the ink cartridge 10, the additive cartridge 11 and the upper and lower parts of the storage tank 13 are connected to the same suction-delivery orifice of the pump 14 respectively through solenoid valves 20, 21, 22 and 23. A so-called main filter 24 is positioned between the bottom of the storage tank 13 and the solenoid valve 23. The bottom of the storage tank 13 is also connected to the ink projection or spraying head. The lower part of the recovery tank 12 is connected to a second delivery-suction orifice of the pump 14 through a solenoid valve 25.

The ink circuit 9 also comprises a pressure regulator 30 connected at the inlet to the compressed air network (5 to 10 bars) via an air filter 31 and at the outlet to the electronic scanning means and ink circuit via two gauged orifices 32 and 33. The outlet of the pressure regulator 30 is also connected:

to the head pressurization through a solenoid valve 34 and a gauged orifice 35, to the storage tank 13 through a solenoid valve 34, a gauged orifice 35 a and another solenoid valve 43, to the pump 14 and decompression orifice 38 through a solenoid valve 37, to the pump 14, to the external discharge through a solenoid valve 40, a regulatable, gauged orifice 41 and a venturi tube 42, the bottom of the filter 31 also being connected to said external discharge through a gauged orifice 46.

The upper part of the storage tank 13 is connected at the common point to the solenoid valve 34 and the gauged orifice 35 by a solenoid valve 43 via the gauged orifice 35*a*.

The upper part of the recovery tank 12 is connected to the venturi tube 42 through a filter 44 and a condenser 45 and its lower part to the suction of the ink groove located at the base of the ink spraying head. A level sensor, e.g. a detector 50, is fixed to the wall of the recovery tank 12. A pressure/temperature sensor 53 is located in the pump 14.

The pressure at the outlet of the pressure regulator 30 is slightly higher than the pressure in the storage tank 13. The storage tank 13 is a double regulation system:

In normal operation:

The solenoid valve 43 is closed. Ink is introduced all at once into the storage tank 13 which, as a result of its air pocket located in its upper part, has a hydraulic, antipulsatory function and serves as a condenser making it possible to level the flow curve. The dimensions of the volumes of the chamber of pump 14 and the air pocket of storage tank 13 are such that the instantaneous addition of a pump volume to the storage tank does not significantly modify its pressure. Typically a ratio of 200 between the air pocket volume and the pump chamber volume is an acceptable lower limit. The pressure is permanently measured with the aid of the sensor 53. An elementary ink addition takes place with the aid of the pump 14 for cyclically replacing the ink consumed by the jet.

When the ink cartridge 10 and recovery tank 12 are empty:

Passage no longer takes place via the pump 14 and the pressure is checked with the aid of the sensor 53. In view of the fact that it is no longer possible to add ink, because the cartridge 10 and recovery tank 12 are empty, the storage tank empties smoothly (flow rate of the jet) and the pressure therein tends to decrease. In addition, in normal operation and with the solenoid valve 34 open, the solenoid valve 43 is intermittently opened for very short times, which makes it possible to maintain the pressure in the storage tank 13. The same amount of air is added as the liquid volume loss.

This system 13 makes it possible to obtain an autonomy of several hours, even with an empty ink cartridge. As a result of the solenoid valves 34 and 43, a very precise pressure regulator is obtained, whose opening/closing cycle is a few milliseconds. It is possible to approach a precision of a few millibars. This gives a regulator with a precision better than 0.1%.

For example, an optimum operation (printing quality and ink autonomy) for an accumulator 13 having ⅓ air and ⅔ ink. If the ink proportion increases, it is then possible to use the regulation system constituted by the solenoid valves 34 and 43.

On starting up the device according to the invention, the aim is to start under high pressure, in order to bring about a good starting of the ink jet. In order to do this, it is possible to bring about a maximum "inflation" of the storage tank using the solenoid valves 34 and 43. This inflation only requires a few seconds and does not increase the machine starting up time.

The device according to the invention makes it possible to measure the air pocket in the storage tank 13. The ink is driven back with the pump 14. The volume of the air layer in the storage tank 13 then decreases by ΔV. On ignoring the ink flow leaving the same during this time, there is a pressure variation ΔP such that:

$$\frac{\Delta P}{P} = \alpha \frac{\Delta V}{V}$$

As the coefficient α (close to 1) is known, ΔV is the displacement of the pump, V the volume of the air pocket, P and ΔP being measured with the aid of the sensor 53, it is possible to deduce V therefrom. It is possible to use an electronic "magnifying lens" for the measurement of ΔP, if the resolution of the measurement converter is not adequate.

Figure 4:
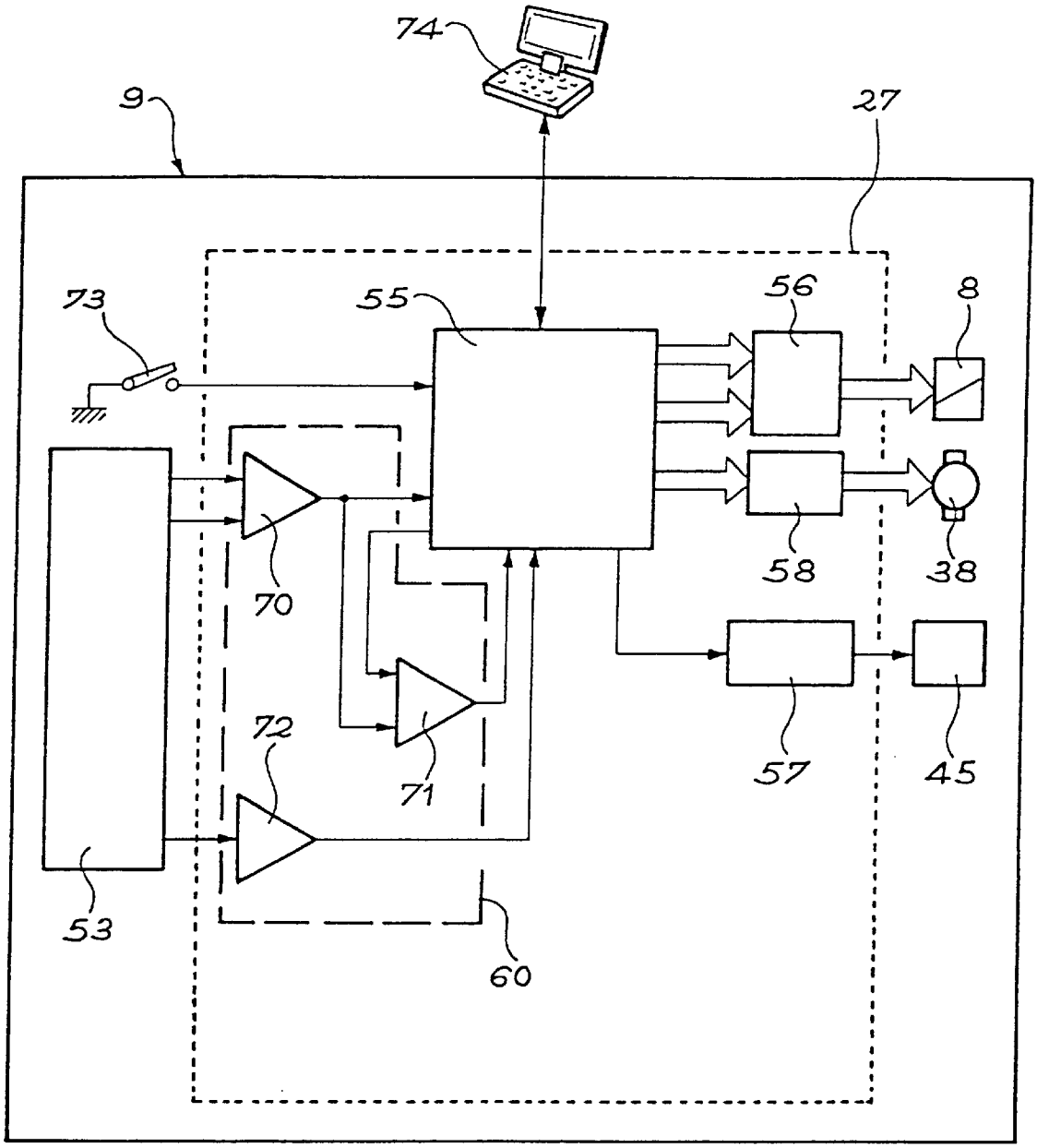
FIG. 4 The electrical diagram of the ink circuit according to the invention.

The electronic card 27 illustrated in FIG. 4 makes it possible to control these various components and comprises:

- a microprocessor 55, e.g. of type μPD78F0058 equipped with its operating program,
- various output interfaces 56, 57 and 58 for controlling the solenoid valves 8, condenser 45, stirrer 38 and control indicators located on the card,
- various input interfaces 60 and 61 for receiving signals more particularly coming from the pressure/temperature sensor 53.

The interface circuit 60 comprises a pressure amplifier 70, a magnifying lens amplifier 71 (the magnifying lens circuit can be eliminated if the measurement converter has a adequate resolution) and a temperature amplifier 72. The electronic card 27 is also connected to safety contacts 73 (door opening) and a terminal 74 by a bidirectional control, series connection.

In order to summarize, the circuit according to the invention has the following specificities:

An accumulator or storage tank 13 with double pressure regulation

The pressure prevailing in the storage tank 13 can be adjusted and maintained by means of the pump 14 with liquid additions or withdrawals, said regulation being precise but slow, by means of solenoid valves 34 and 43 by adding or removing air, said regulation being precise and fast.

This double regulation is of great interest, because it makes it possible to separate the use of the pump 14 from maintaining the ink jet speed. The first application is an increase of the operational autonomy of the circuit when there is no longer any ink in the tanks (ink cartridge and recovery tank). It is possible to use all the ink contained in the circuit. Another possibility is the rapid change of the operating conditions (pressure rise or fall) by regulating the pressure in air (with solenoid valves 34 and 43). This possibility is used for jet starting operations (e.g. high pressure starting), stopping the jet (e.g. low pressure stopping) and maintenance operation (of the jet or machine).

A measurement of the temperature (53) in the core of the system (ink temperature measurement)

The pressure sensor 53 is located in the pump 14. In order to better translate the behaviour of the circuit, said sensor has been optimized by integrating into it the temperature measurement. This temperature measurement is in particular used for regulating the ink quality as a function of its temperature (dependent on the ambient temperature) it is possible to work with a constant concentration (or any other state between a constant concentration and constant viscosity) by interpreting the viscosity and temperature measurements relative to the ink curve "viscosity=f (temperature)". This curve, which is specific to each of the inks or dependent on the production batch, is stored in the electronic part of the machine.

The location of the main filter 24

The main filter 24 is positioned between the pump 14 and the accumulator 13. This preferred location makes it possible to measure the clogging of the filter 24 by measuring the time evolution of the power required for transferring ink from pump 14 to storage tank 13 through said filter 24 and to have an operating pressure (pressure in storage tank 13), which remains independent of the degree of clogging of the filter (static measurement of the storage tank pressure with the solenoid valve 23 open).

The use of a conventional air pressure regulator 30

The circuit equipped with an air regulator adapted to the conditions of the system or network (with solenoid valves 34 and 43) requires no special performance characteristics on the part of the inlet regulator 30. The only operating condition of the circuit is to have a pressure at the outlet of regulator 30 higher than the operating pressure. The function of the inlet regulator 30 is solely to prevent pronounced pressure variations (a direct connection to the system would involve this risk). A submicron filter with permanent purging associated with said regulator makes it possible to obtain an air quality (no water, oil and impurities) compatible with the functionality of the circuit.

A reventing of the cartridges 10 and 11 by the storage tank 13

The pumping of liquid in the tight cartridges 10 and 11 leads to a vacuumizing of the latter. In order to guarantee the suction characteristics of the pump 14 in cartridges 10 and 11, a pressure level must be maintained therein which is close to atmospheric pressure. This is brought about by means of the air of storage tank 13 via solenoid valve 22. The pressure sensor 53 integrated into the pump 14 makes it possible to accurately control the operation. This principle avoids atmospheric air sampling. Thus, if e.g. the solenoid valve 22 had its inlet under atmospheric pressure, there would be a risk of drying and consequently sticking on said solenoid valve.

The circuit according to the invention is closed for such a sequence. It is even possible to optimize the operating sequences so that the solenoid valve 22 has its two orifices in liquid throughout the operation of the printer, the passage to air of the solenoid valves being very brief and being solely associated with the cartridge "reflation" cycle.

A reventing of the cartridges 10 and 11 by ambient air

A variant of cartridge reventing can be obtained by using solenoid valve 22*a*. To prevent the risk of said solenoid valve sticking, it is placed between solenoid valve 21 and the additive cartridge. Thus, the additive dries without leaving behind a dry extract and consequently without any possibility of creating a sticking situation.

The additive cartridge is revented by opening said solenoid valve 22*a*. The reventing of the ink cartridge takes place by the simultaneous opening of solenoid valves 22*a*, 21 and 20.

The presence of a single level detector 50

One of the main functions of such a circuit is to prevent an ink transfer to the parts in air (risk of ink drying and therefore sticking of the solenoid valves). The only point which cannot be controlled by the pressure sensor 53 is the ink level in the recovery tank 12. To avoid any serious operating incident (overflowing tank 12), said recovery tank 12 is equipped with a level detector 50.

A total security is also provided by such a level detector 50 (of the capacitive or Hall effect type with a contactless measurement through the tank wall). The technology of the sensor used permits both an all or nothing measurement (for determining one or more thresholds) or a continuous measurement (with an analog image output of the liquid level). Bearing in mind the high flammability of inks used (explosion risk) the use of a contactfree sensor (no electrical contact in the ink) makes it possible to obtain by design an intrinsic operating safety and security.

A protection filter 44 for the venturi tube 42

This filter 44 is much smaller than that of the previously described prior art device.

A recovery circuit implemented with a controlled supply venturi tube

The vacuumizing of the recovery tank is ensured by the venturi tube 42, which is supplied with pressurized air when the solenoid valve 40 is open. A few seconds after stopping the jet, the solenoid valve 40 is closed, which avoids a recovery tank drying risk in the case of a long stoppage. In addition, when closed said solenoid valve 40 avoids an evaporation of the volatile components when the jet is not operating. This prevents an evolution of the quality of the ink for printer use waiting periods. These technical and economic plus points justify the presence of said solenoid valve 40 not present on the known, prior art circuits.

A Peltier effect cell condenser 45

The principle of such a condenser 45 is well known and consists of using the cold source of said system for condensing and consequently recovering the volatile components of the ink (reduction of additive consumption and therefore operating costs for the customer). The originality compared with the same principle used in the prior art devices consists of not permanently supplying said component, which makes it possible to adapt its efficiency. When it is wished to reduce the system efficiency, its supply time is reduced. The modulation of the electrical supply leads to a modulation of the efficiency. This modulation principle permits an adaptation of the efficiency as a function of the type of head used and the type of ink. This modulation also makes it possible to improve the response time of the automatic control of the ink quality.

A central pump 14

The fluid transfers between the different volumes takes place by a pump 14 located in the centre of the circuit and which has a switching yard function. It is equipped with a pressure sensor 53. The temperature measurement functionality has been added to the sensor so as to be able to more correctly control the quality of the ink (measurement of the ink temperature in the core of the system).

Figure 5:
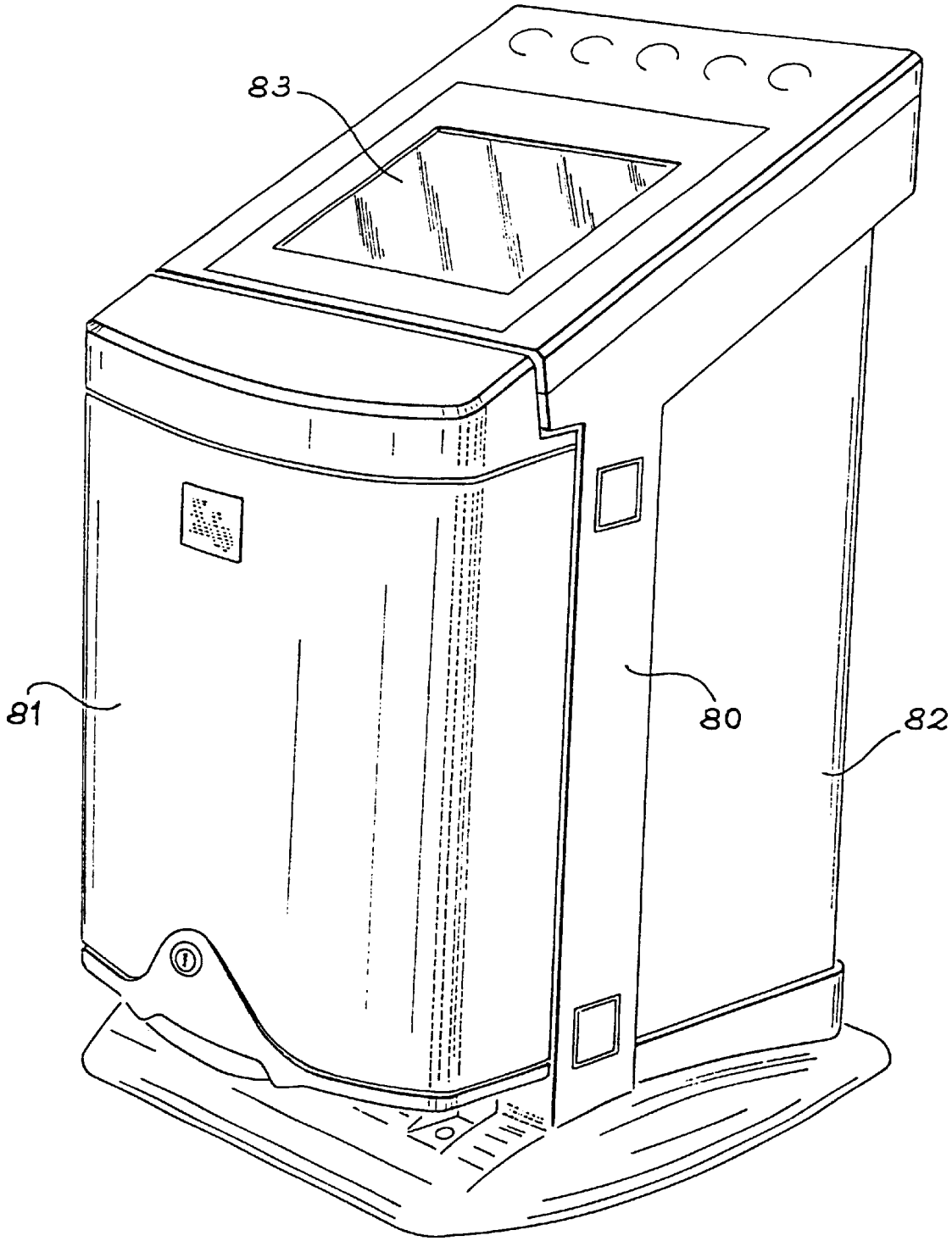
FIGS. 5 & 6 An ink jet machine using the circuit of the invention.
Figure 6:
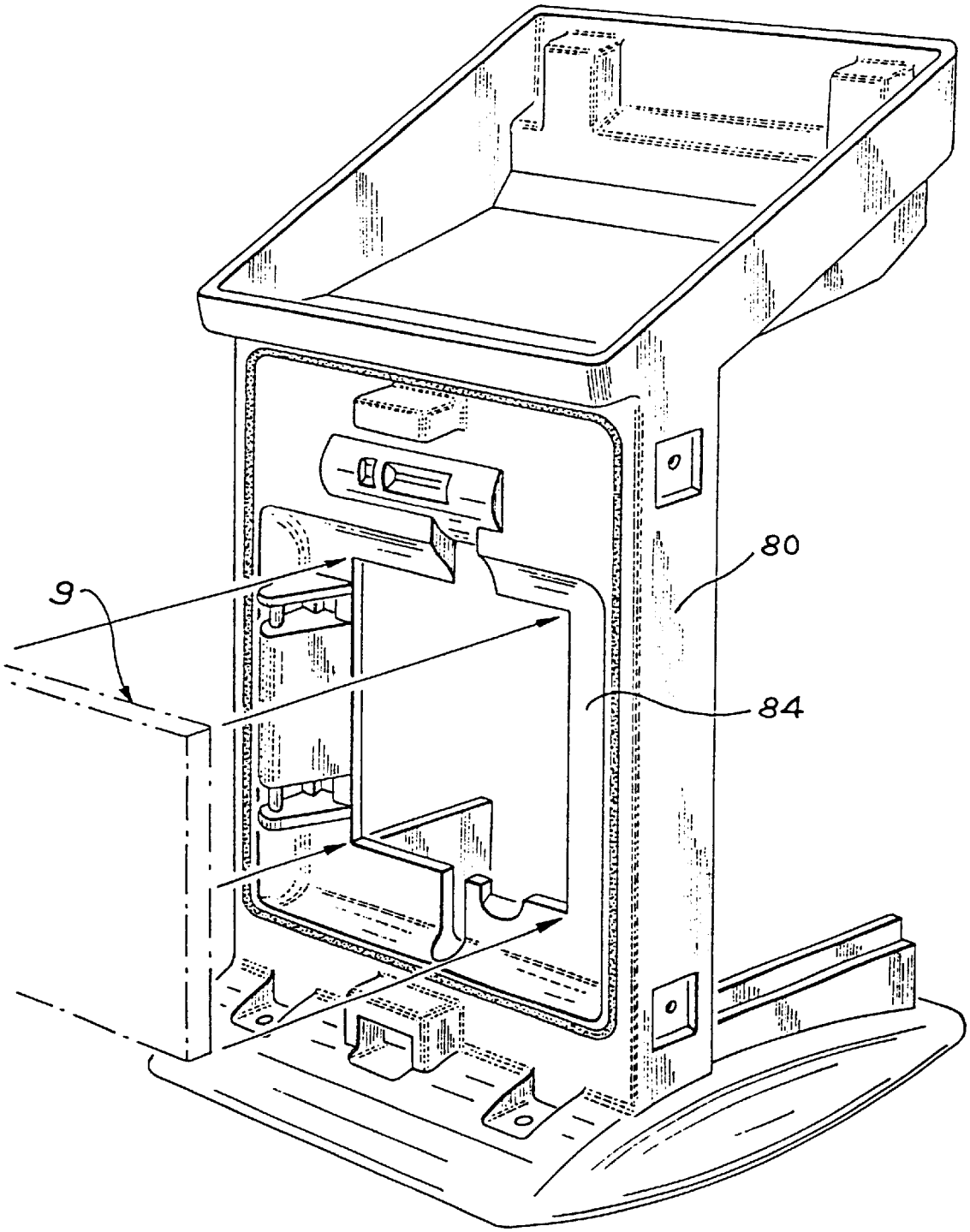

The ink circuit 9 according to the invention can be included in an ink jet machine, as illustrated in FIGS. 5 and 6. FIGS. 5 and 6 show a frame 80 on which are positioned a front door 81, a rear cowling 82, an operator interface 83, which can be a screen plus a tactile faceplate, a graphic screen plus a keyboard or an alphanumeric or graphics screen plus a few keys. FIG. 6 shows a support zone 84, where the fixing of the circuit 9 according to the invention takes place. This support zone makes it possible to isolate from the interior of the machine the hydraulic and electrical compartments (safety standards).

However, it can also be sold O.E.M. (Original Equipment Manufacturer) to manufacturers of conditioning machines or conveyors, who wish to integrate the ink jet function into their machine. The device according to the invention can be in the form of an electronic control unit and an ink circuit interconnected by a series link (the messages carried being interpretable by a multipoint protocol and the electronics can control two heads with two different colours). The electronic control unit and ink circuit can be mutually displaced by between a few centimetres and several metres.

The modularity of the circuit also permits a use in a "bank" of n circuits (multipoint remote control for a single control unit of type 74) for great width, black and white or colour printing applications.

What is claimed is:

1. Ink circuit comprising an ink cartridge (10), an additive cartridge (11), a recovery tank (12), a storage tank (13), a main filter (24), solenoid valves (8), an ink transfer pump (14) equipped with a pressure/temperature sensor (53) which provides information on the hydraulic and thermal operating conditions, and an air pressure regulator (30), said ink circuit comprising a double face support unit having a front face and a rear face, said front face having hydraulic and pneumatic components installed thereon, said rear face having electrical and electronic components installed thereon, such that the hydraulic and pneumatic components of said ink circuit are isolated from the electrical and electronic components thereof by said support unit, all hydraulic, pneumatic, electric, and electronic components being accessible from outside said support unit.

2. Ink circuit according to claim 1, wherein the air/ink separation is ensured by an arrangement of the components functioning in air **(30, 31, 32, 33, 34, 35, 35*a*, 37, 38, 40, 41, 42, 43, 44, 45, 56) in the upper part of the circuit and the components functioning mainly in ink (14, 20, 21, 22, 23, 24, 25, 53)** in the lower part of said same circuit.

3. Ink circuit according to claim 1, wherein the hydraulic and pneumatic links take place without any piping and without any connection and are integrated into the support unit in the form of channels.

4. Ink circuit according to claim 1 comprising a double pressure regulation storage tank (13), the first regulation operating in liquid by means of the pump (14) and corresponding to the jet ink supply and the second regulation functions in air.

5. Ink circuit according to claim 1 comprising two solenoid valves (43, 34), one being positioned between the storage tank (13) and the head pressurization or pressurizations through one or more gauged orifices (35) and the other between the gauged orifice or orifices (35) and the pressure regulator (30).

6. Ink circuit according to claim 1, wherein the pump (14) is located below the recovery tank (12) and storage tank (13).

7. Ink circuit according to claim 1, wherein the main filter (24) is located between the pump (14) and the storage tank (13).

8. Ink circuit according to claim 1, comprising a regulatable venturi tube (42) protected by a coalescence filter (44).

9. Ink circuit according to claim 8, wherein the outlets of the filter (31) and venturi tube (42) are positioned close to one another, so as to dilute the venturi tube discharges.

10. Ink circuit according to claim 1, wherein the filters (24, 44) are installed on the support unit by a rapid fixing system.

11. Ink circuit according to claim 1 comprising a single, contactless, level detector (50) in the recovery tank.

12. Ink circuit according to claim 1 comprising a programmable efficiency condenser (45) located at the outlet of the recovery tank (12).

13. Ink circuit according to claim 1, wherein the ink (10) and additive (11) cartridges are tight and maintained at a pressure close to atmospheric pressure either by the air of the storage tank (13) by means of an adapted cycle of several solenoid valves (22; and 20 or 21), or by ambient air by means of an adapted cycle of several solenoid valves **(22*a*, 20, 21), the operations being controlled by the pressure sensor (53)**.

14. Conditioning machine or conveyor using an ink circuit according to any one of the claims 1 to 13.

15. Ink jet machine using an ink circuit according to any one of the claims 1 to 9.

* * * * *

UNITED STATES PATENT AND TRADEMARK OFFICE

CERTIFICATE OF CORRECTION

PATENT NO. : 6,352,324 B1
DATED : March 5, 2002
INVENTOR(S) : Pagnon et al.

It is certified that error appears in the above-identified patent and that said Letters Patent is hereby corrected as shown below:

Column 12,
Line 32, please delete "claims 1 to 9" and insert therefor -- claims 1 to 12 --.

Signed and Sealed this

Sixteenth Day of July, 2002

*Attest:*

*Attesting Officer*

JAMES E. ROGAN
*Director of the United States Patent and Trademark Office*